US006016921A

United States Patent [19]

Hauch

[11] Patent Number: 6,016,921

[45] Date of Patent: Jan. 25, 2000

[54] SIZING PANEL FOR ROTATING CYLINDRICAL SEPARATOR

[75] Inventor: David A. Hauch, Afton, Minn.

[73] Assignee: Carter Day International, Inc., Minneapolis, Minn.

[21] Appl. No.: 08/980,605

[22] Filed: Dec. 1, 1997

[51] Int. Cl.[7] ..... B07B 1/49

[52] U.S. Cl. ..... 209/399; 209/403; 209/406; 209/407

[58] Field of Search ..... 209/288, 270, 209/293, 296, 687, 397, 399, 401, 403, 405, 406, 407

[56] References Cited

U.S. PATENT DOCUMENTS 2,423,442 7/1947 Dustan ..... 92/35

2,575,484 11/1951 Borton ..... 241/91

4,720,473 1/1988 Welch et al. ..... 502/21

*Primary Examiner*—Donald P. Walsh

*Assistant Examiner*—Brett C Martin

*Attorney, Agent, or Firm*—Craig M. Gregersen; Briggs and Morgan

[57] ABSTRACT

The present invention provides a separator having a rotatable frame and a plurality of sizing panels attached thereto. The frame has a pair of end rings and a plurality of stringers extending longitudinally between the end rings. Each stringer has a substantially rectangular cross section. The cylinder panels each have a pair of circumferentially extending edges and a pair of longitudinally extending edges. Each sizing panel includes a pair of longitudinally extending flanges that engage the stringer in the separator frame and is clamped in place within the channel of a clamp bar attached on the external surface of the cylinder.

2 Claims, 3 Drawing Sheets

SIZING PANEL FOR ROTATING CYLINDRICAL SEPARATOR

FIELD OF THE INVENTION

The present invention relates generally to separators, that is, equipment utilized to sort particulate matter such as seeds, grains, and other granular or particulate material, by size, and in particular to an improved separator that is more durable, less resistant to stress fatigue, and easier to maintain.

BACKGROUND OF THE PRESENT INVENTION

Rotating sorters or sizers, commonly called separators, are well known in the art of classifying particulate matter, such as seeds, grains, stones, etc., by their size. Such separators typically include a housing that supports a rotatable cylinder. The "cylinder" usually has a tubular configuration, though any structure having a regular polygonal cross section would suffice. The cylinder includes a frame structure comprising a pair of end rings that support either a single sizing unit conforming to the frame structure or individual panel sections attached to the frame structure and to each other. Representative examples of such rotating separators can be found in U.S. Pat. No. 779,149 to Cross; U.S. Pat. No. 1,284,669 to Haug; U.S. Pat. No. 1,427,031 to Stepp; U.S. Pat. No. 2,204,835 to Traylor; U.S. Pat. No. 4,184,944 to Tytko; U.S. Pat. No. 4,222,865 to Valeri et al.; U.S. Pat. No. 4,670,136 to Schmidt et al.; U.S. Pat. No. 5,049,262 to Galton et al.; U.S. Pat. No. 5,213,217 to Galton et al.; U.S. Pat. No. 5,346,071 to Page et al; and U.S. Pat. No. 5,507,396 to Hauch. Such separators can be classified into two general types: those with sizing panels that size the particulate matter with the use of holes through which the particles smaller than the holes fall and those with panels having clefts or indentations that capture the smaller sized particles and rotationally carry them away from the larger particles.

In a typical operation of the latter type of separator, the granular material to be sorted is fed into the interior of the rotating cylinder of the separator. There, material less than a predetermined size is "captured" within indentations or clefts in the cylinder and carried upwardly and rotationally away from the larger material particles, which remain in the lower portion of the separator. As the captured particles near or reach the apex of the rotational motion of the cylinder, they fall downwardly under gravitational influence into an auger, which carries them away to be disposed of or utilized as desired. The larger sized particles are then carried out of the rotating cylinder. It will be appreciated that the size of the particles sorted is dependent upon the size of the cylinder indentations.

Separators having a single, unitary cylinder panel with two longitudinally attached edges are generally easily attached to the separator frame. The single panel cylinder separators, can present structural fatigue problems, however. These separator cylinders generally have a tubular configuration and present two circumferential edges at opposite ends for attachment to a pair of end rings on the separator frame. Additionally, the screen has two longitudinal edges that are attached to each other.

In operation, as the cylinder rotates, the weight of the material being sorted is constantly being transferred to that portion of the cylinder at the lowest point of the rotation. This rotating, cylinder-flexing load thus causes the cylinder to continuously flex downwardly. As just mentioned, the cylinder is often attached only along its circumferential edges to the frame structure. Thus, the shifting load carried by the cylinder has been known to fatigue the cylinder along its circumferential edges, causing the creation of cracks along those very edges. Stated otherwise, in the known prior art single cylinders as the separator was rotated, the cylinder would continuously deform with each revolution thereof, leading to life cycle fatigue and cracking along the attached circumferential edges.

Because of the loading problems just discussed, hoops are often welded to the exterior surface of the separator cylinder to provide additional support. While the hoops function generally as intended, the hoops also add mass that must be rotated by the motor rotationally driving the separator cylinder, thus creating additional wear and tear on the motor. Additionally, the extra weight of the hoops requires the use of stronger bearing support structures. Another disadvantage of this construction is that welding or otherwise attaching the hoops to the outer surface of the separator cylinder entails another manufacturing step that increases the cost of manufacture in terms of time, manpower, and materials cost. An improvement in the separator art relating to trommels, that is, to separators having screens with holes, is shown in the foregoing Hauch '396 patent.

To avoid this loading problem and the life cycle fatigue created by a single cylinder panel, many of the devices disclosed in the prior art have utilized a multiple cylinder panel construction. In a typical multiple panel cylinder construction, the cylinder would be formed from at least two, and usually three or more, panel sections that would be individually attached to the end rings along their circumferential edges. In addition, the panel segments would be attached to each other along adjoining longitudinally extending edges. This reduces the prior art loading problem, but the prior art cylinder panel sizer constructions are complex, making their construction and maintenance difficult.

Prior art designs are also subject to leaking along the joints between sizing panels as a result of an inability to adequately accommodate size variations in the sizing panels. For example, in prior art methods of attaching sizing panels the panels are secured substantially parallel to a tangent to the cylinder circumference, which inhibits the ability of the design to accommodate size variations. In addition, in prior art designs, the flanges are used for attachment to each other, with the circumferential edge only being attached to the rotating frame since there are no stringers present in this design. Consequently, any dimensional variation in the sizing panels is accommodated through the use of sealing gaskets installed between the attached flanges. With this prior art design, however, the bolts used to attach the flanges to each other are often over tightened. This overtightening can distort the flanges, which can in turn can cause the particulate matter being sized to leak out of the cylinder along the attachment joint.

It would be desirable to have a sizer or separator that utilizes multiple cylinder panels to reduce the fatigue caused by the rotating load but that is simpler in construction, that is easier to install and take apart for maintenance, that costs less to build than the prior art structures, and that is less susceptible to joint leakage.

SUMMARY OF THE INVENTION

It is an object of the present invention to provide new and improved apparatus that is not subject to the foregoing disadvantages.

It is another object of the present invention to provide an improved separator that includes a multiplicity of cylinder panels attached along their longitudinal edges to a rotatable frame structure.

It is still another object of the present invention to provide an improved separator that utilizes multiple cylinder panels attached to a rotatable frame that is readily assembled with a minimum of tools.

It is a further object of the present invention to provide a separator cylinder construction that does not require the utilization of hoop stiffeners.

The foregoing objects of the present invention are provided by a separator having a rotatable frame and a plurality of sizing panels attached thereto. The frame has a pair of end rings and a plurality of stringers extending longitudinally between the end rings. Each stringer has a substantially rectangular cross section. The cylinder panels each have a pair of circumferentially extending edges and a pair of longitudinally extending edges.

The disclosed separator cylinder attached to the frame comprises a plurality of cylinder sections, typically two to three, that are attached to each other and to the separator frame along their elongate edges. Each cylinder section includes a pair of longitudinally extending flanges that engage the stringer in the separator frame and clamped in place within the channel of a clamp bar. By attaching the cylinder sections along their longitudinally extending edges, the deformation of the cylinder due to the weight of the product in the separator is reduced and the fatigue on the cylinder is minimized.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
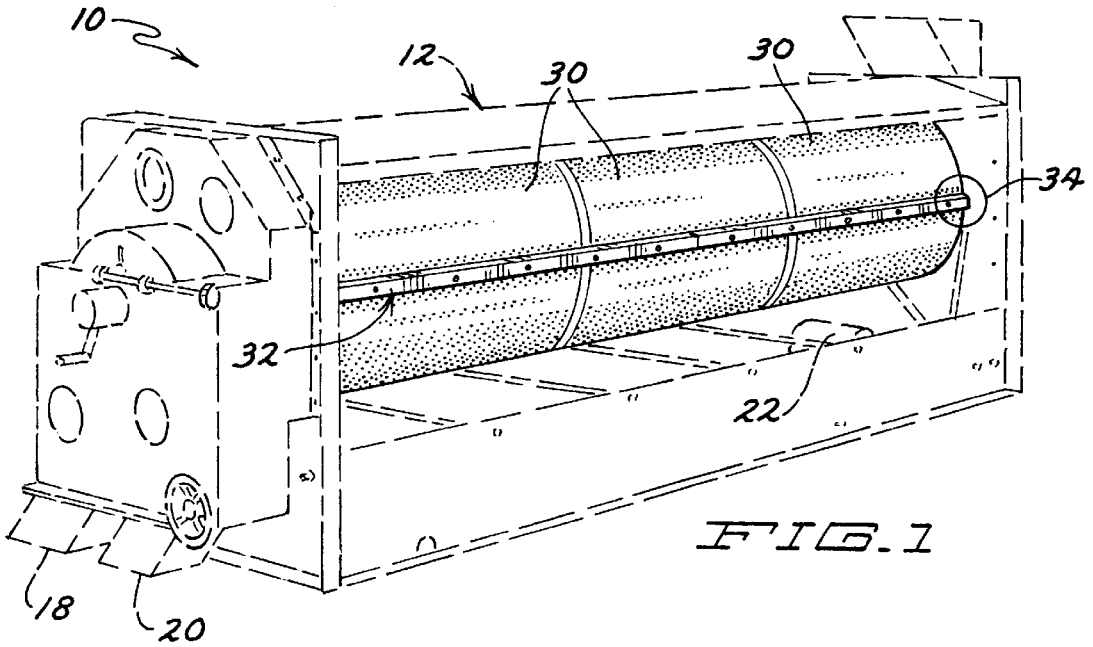
FIG. 1 shows a sizer apparatus or separator wherein the present invention may find application.

Referring to FIG. 1, a separator 10 in accord with the present invention is shown partially in phantom outline. Separator 10 includes a housing 12, shown entirely in phantom outline, that rotationally mounts a sizing cylinder 14. Housing 12, among other functions, serves to reduce the amount of noise released into the ambient environment, to protect individuals from injury by reducing the opportunity for someone to injuriously engage the operating machinery, and to reduce the amount of dust released during the sizing operations. Housing 12 includes a material inlet or chute 16 that feeds the particulate matter to be sorted into the rotatable cylinder 14. Within cylinder 14, though not shown, is an auger that receives material sorted by the rotating action of the cylinder 14 and that conveys the sorted material out of the separator via an outlet 18. The larger sized particulate matter is discharged from the cylinder 14 via an outlet 20. Separators such as the separator 10 will typically include a drive motor 22 for rotationally driving the cylinder 14 as well as the auger mounted therein. The manner of making the drive connections between the motor 22 and the cylinder 14 are well known in the art and illustration thereof is not necessary to an understanding of the present invention.

As seen in FIG. 1 cylinder 14 comprises a plurality of sizing panels 30. Sizing panels 30 are attached to each other along a joint 32. A detail of the joint 32 is indicated by the circle 34, which is shown in enlarged detail in FIG. 2.

Figure 2:
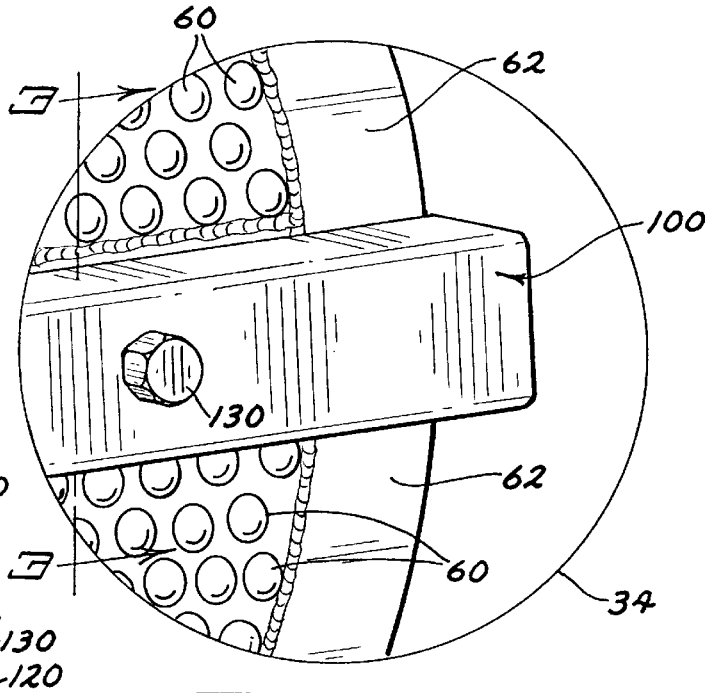
FIG. 2 is an expanded view of the circled portion of the apparatus shown in FIG. 1.
Figure 3:
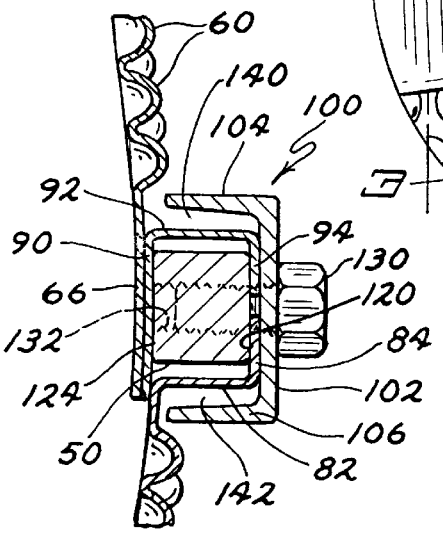
FIG. 3 is a cross sectional view of portion of the sizer apparatus circumscribed by the circle in FIG. 1 taken along viewing plane 3—3 of FIG. 2.
Figure 4:
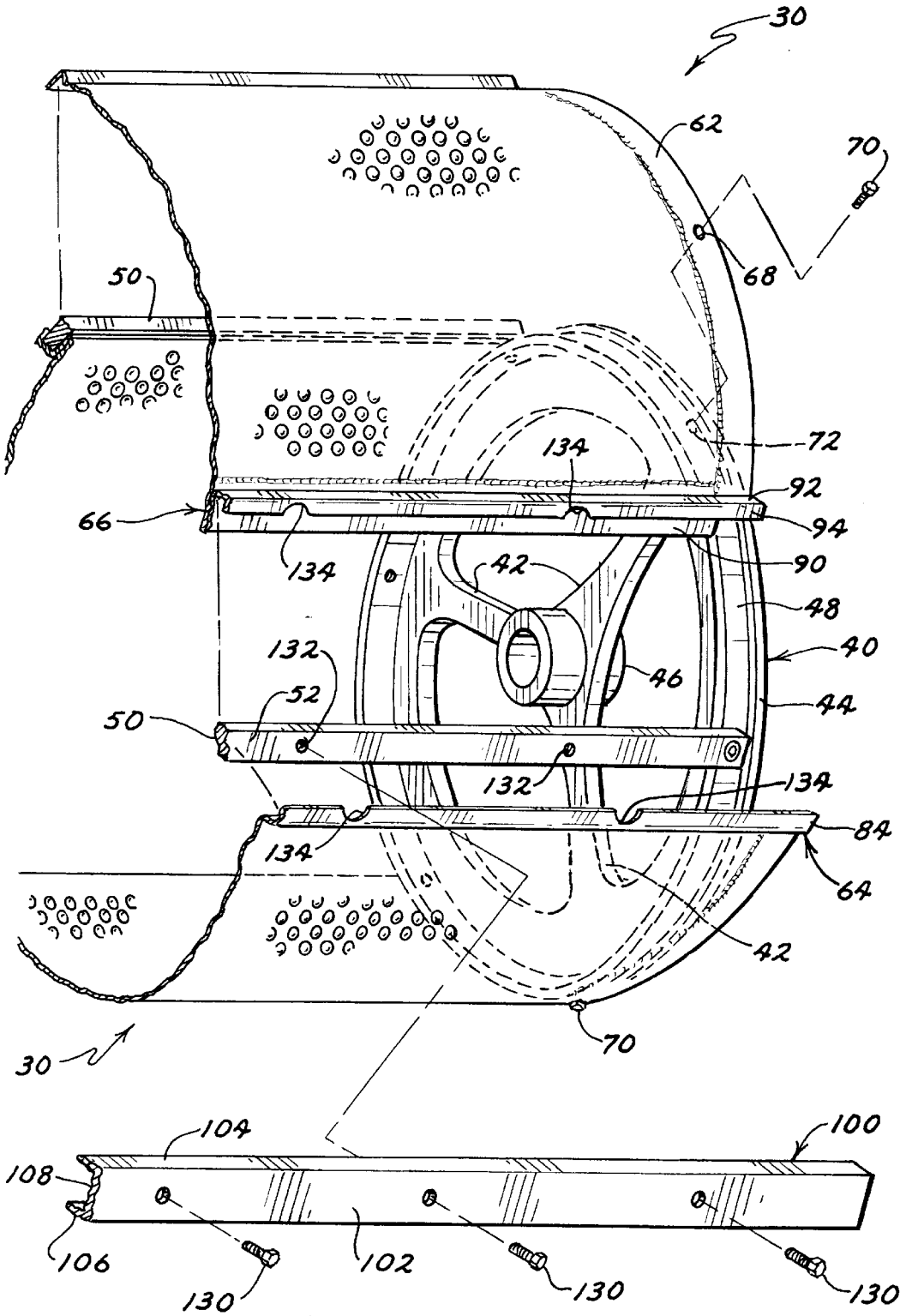
FIG. 4 is an exploded perspective view of a separator joint with a pair of cylinder panels and a clamping channel in accord with the present invention.

Referring now to FIGS. 2–4, it can be seen that the cylinder 14 includes a pair of end rings 40, only one of which is shown in the figures. End ring 40 includes a plurality of spokes 42 extending inwardly from an outer rim 44 that mounts the sizing panels 30 for rotation. The spokes 42 converge at the center of the end ring to form a hub 46 that is rotationally attached to a drive shaft (not shown) driven by motor 22 in a manner well known to the art. The outer rim 46 includes a substantially tubular surface 48 that engages the circumferential edge of the sizing panels as will be explained further below.

Cylinder 14 also includes a plurality of stringers 50 that extend longitudinally between the end rings 40. The number of stringers 50 will equal the number of sizing panels 30. As best illustrated in FIG. 3, stringer 50 has a substantially rectangular configuration and includes an outwardly disposed surface 52. Stringers 50 are fastened to end rings 40 with fasteners 54, which may be bolt/nut combinations, or are otherwise attached to the end rings 40 in any known manner, including welding. Attachment of the stringers to the end rings 40 with removable fasteners facilitates assembly and maintenance operations, however.

Figure 6:
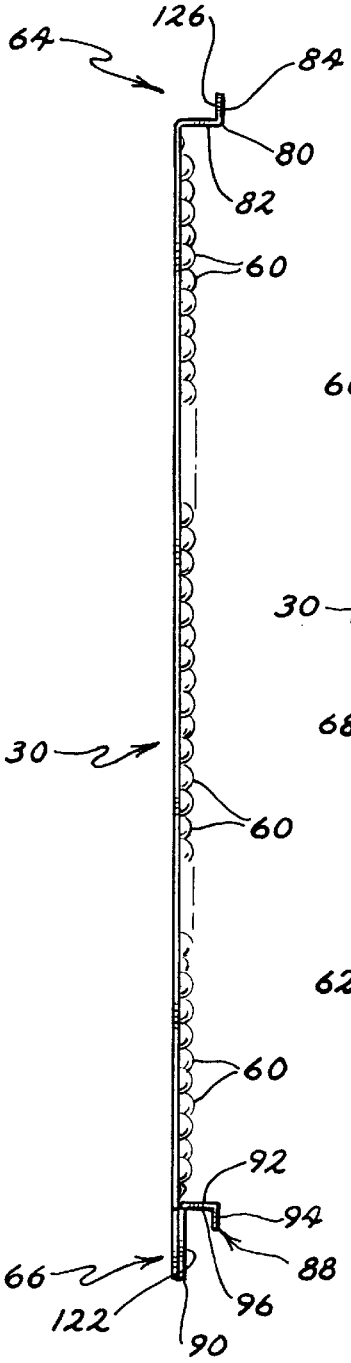
FIG. 6 is an end view of a cylinder panel showing its planar form before shaping it into a semi-circular arc for attachment to the separator frame.
Figure 5:
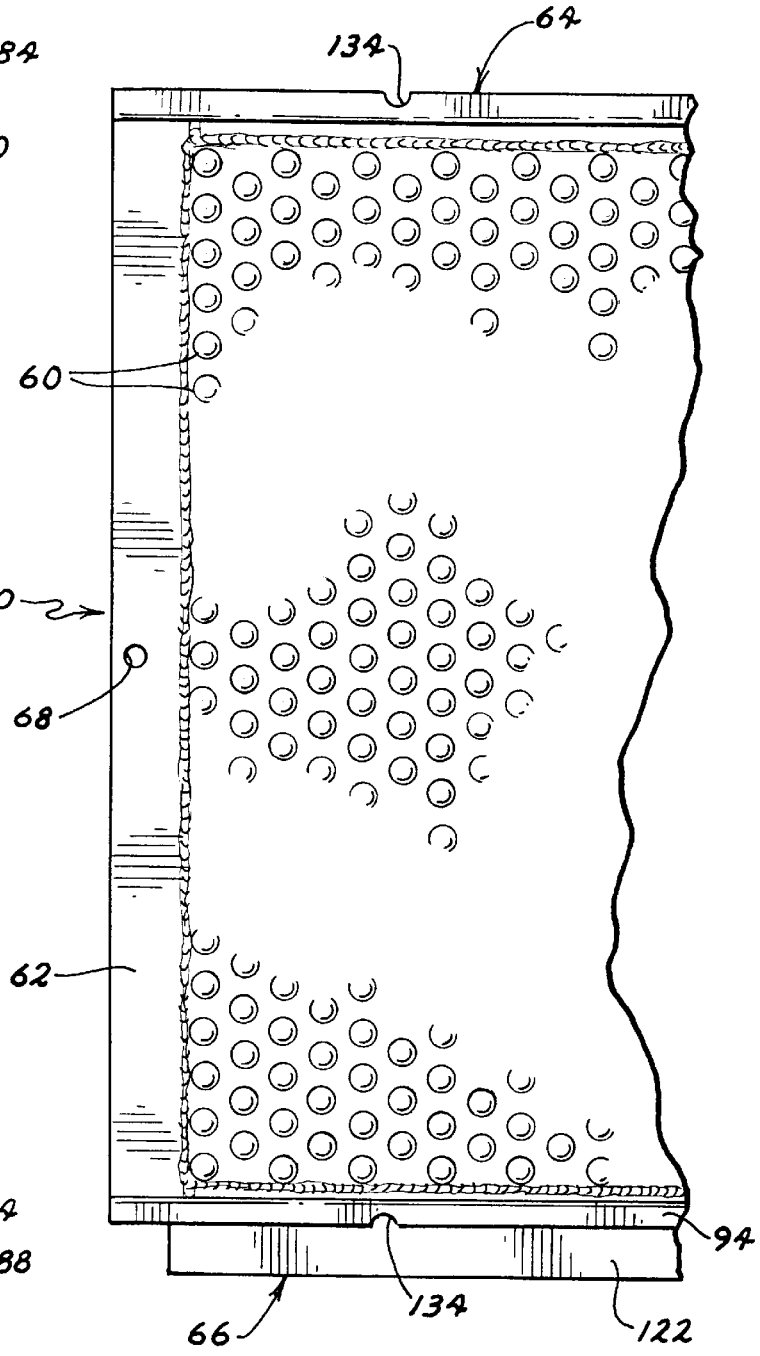
FIG. 5 is a plan view of an end of a cylinder panel in accord with the present invention.

Referring now principally to FIGS. 2–3 and 5–6, a sizing panel 30 in accord with the present invention will be described. As best seen in FIGS. 5 and 6, each sizing panel 30 is initially formed as a substantially flat metal sheet into which a plurality of sizing indentations or clefts 60 of a predetermined shape and size are impressed. Sizing panels 30 include a pair of circumferential edge portions 62 and lateral edge portions 64 and 66. The edge portions 62 include at least one aperture 68 to be used to fasten a sizing panel to an end ring 40 when the panel is being installed. As best seem in FIG. 4, a fastener such as bolt 70 can be used to fasten a sizing panel at its circumferential edge 62 to the end ring 40 by inserting it through aperture 68 and into an aperture 72 on the end ring 40.

Edge portion 64 includes a flange 80 comprising a radially outwardly extending member 82 and a member 84 extending laterally therefrom at substantially a right angle. Edge portion 66 includes a z-shaped flange 86 formed either by fixedly attaching, such as by riveting, a flange member 88 to the edge portion 64 or in part by bending the edge portion 66 back against itself. The latter method of formation, though within the scope of the present invention, is not presently preferred because of structural weaknesses introduced into the edge portion by such a bending operation. Flange member 88 includes a first member 90 that is affixed to the edge portion 66. A second member 92 extends radially outwardly from the first member 90 while a third member 94 extends laterally from member 92 at substantially a right angle. It will be observed that members 90, 92, and 94 cooperate to form a receiving cavity or channel 96 for stringer 50.

Separator cylinder 14 further includes a clamp bar 100. Bar 100 includes a base web 102 and a pair of side webs 104, 106 extending therefrom at substantially a right angle. Webs 102, 104, and 106 cooperatively define a channel 108. The base web 102 includes a plurality of through holes 110 used for fastening the clamp bar 100 to the cylinder 14.

The features of the present invention having been substantially previously described, the assembly of the cylinder 14 will now be described. The end rings 40 and the stringers 50 will first be assembled within the housing 12. A sizing panel 30 will then be positioned relative to a stringer 50 such that edge portion 66 and specifically cavity 96 receives stringer 50 therewithin as best seen in FIG. 3. As shown there, the inner surface 120 of member 94 engages the radially outer surface 52 of stringer 50. The radially outer surface 122 of member 90 engages the radially inward surface 124 of stringer 50. Thus, the stringer 50 is captured within the cavity 96. At the other edge of sizing panel 30, the edge portion 64 will be positioned relative to the next adjacent stringer 50 such that the radially inward surface 126 of arm 84 engages the radially outer surface 52 of stringer 50. The sizing panel 30 can then be attached to the end rings 40 through the use of a fastener 70 inserted though holes 68 at each end thereof.

A second sizing panel 30 can then be positioned for attachment. The same process as noted above is repeated. Where the edge portion 64 and edge portion 66 of adjacent sizing panels 30 engage a stringer 50, clamp bar 100 can then be attached to the stringer, capturing the edge portions 64, 66 of adjacent sizing panels within the channel 108 formed by the webs 102, 104, and 106 of the clamp bar 100. The clamp bar can then be removably affixed to the stringer by use of a plurality of fasteners such as bolts 130 that threadably engage respective threaded holes 132 within stringer 50. It will be observed with reference to FIG. 4 that the arm 84 and the member 94 each include a cutaway portion 134 configured to accommodate the bolts 130. Successive sizing panels can be similarly attached to the cylinder 14 until the structure is completely assembled.

The separator in accord with the present invention presents several advantages over the prior art attachment methods. First, referring specifically now to FIG. 3, it will be observed that the web 104 and the web 106 are spaced from the member 92 and the arm 82 respectively. That is, the present invention contemplates a sizing gap 140 between web 104 and member 92 and a sizing gap 142 between web 106 and arm 82. These gaps 140, 142 accommodate dimensional variations in the sizes of the sizing panels 30 and insure that the panels 30 tightly engage the end rings 40.

It will be further observed that the sizing panels are secured to the stringers using fasteners that extend perpendicularly to a tangent of the cylinder 14 circumference. In prior art methods of attaching sizing panels the panels are secured substantially parallel to a tangent to the cylinder circumference. Attaching the panels in the manner of the present invention allows the load carried by the bolts 130 to be independent of the accommodation made of the circumferential length variations in the individual sizing panels, which is provided as noted by the sizing gaps 140 and 142 and the cut away portions 134. As noted earlier, in prior art designs, the flanges are used for attachment of the longitudinal sizing panel edges to each other since there are no stringers, with the circumferential edges only being bolted to the rotating frame, that is, the end rings. Thus, any dimensional variation in the sizing panels is accommodated through the use of sealing gaskets installed between the clamped flanges. As noted previously, with this prior art design, however, the bolts attaching the flanges to each other are occasionally over tightened, resulting in a distortion of the flanges that can lead to leaking of particulate matter being sized along the attachment joint.

Another advantage of the present invention is that by clamping the edge portions 64 and 66 between the stringer 50 and the clamp bar 100 the present invention provides a joint that is structurally sound In addition, the stringer/clamp bar is stiffer than conventional flange constructions of prior art designs and distributes the clamp load along the entire length of the joint.

An additional advantage over the prior art constructions is that the sizing panels can be made of a consistent thickness of sheet metal, reducing fabrication costs over prior art designs where a uniform thickness was not possible due to the need to provide clamping flanges. The present invention also eliminates the need for heavy hoop stiffeners.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed is:

1. A separator comprising:

a frame, said frame comprising:

a pair of substantially circular spaced apart end rings each having an outer surface; and a plurality of longitudinally extending stringers attached to said outer surface of said end rings and extending therebetween, each said stringer having a rectangular configuration including radially inner substantially flat surfaces and circumferential substantially flat side surfaces; and a plurality of sizing panels removably attached to said stringers and said end rings, each said sizing panel including:

a sizing portion, said sizing portion including inner and outer surfaces, said inner surface having a plurality of sizing indentations therein;

a pair of circumferential edges for attachment to said outer surfaces of said end rings; and first and second longitudinally extending side edges for non-rigid engagement with said stringers, wherein:

said first side edge includes a radial arm extending radially outwardly away from said panel and a lateral arm extending away from said radial arm at a substantially right angle thereto, wherein said lateral arms engage a said radially outer surface of a said stringer; and said second side edge includes a radial arm extending radially outwardly away from said panel;

a lateral arm extending away from said radial arm at a substantially right angle thereto; and an attachment arm, said attachment arm being fixedly attached to said sizing panel with said radial arm extending radially outwardly therefrom, wherein said second edge radial, lateral, and attachment arms form a longitudinally extending, three-sided channel for receiving a said stringer therein such that the radially inner surface of said stringer engages said attachment arm and said radially outer surface of said stringer engages said lateral arm; and a plurality of clamp bars, a said clamp bar being rigidly attached to a said stringer and trapping a said first edge lateral arm and a said second edge lateral arm of adjacent sizing panels between said clamp bar and said stringer.

2. The separator of claim 1 wherein said clamp bars each define a clamp bar channel, said clamp bar channel receiving said edges and said stringer.

* * * * *